US008734047B2

(12) United States Patent
Hughes, Jr.

(10) Patent No.: US 8,734,047 B2
(45) Date of Patent: May 27, 2014

(54) TRAFFIC CONTROL MARKER WITH MESH BASE

(71) Applicant: Robert K. Hughes, Jr., Fort Meyers, FL (US)

(72) Inventor: Robert K. Hughes, Jr., Fort Meyers, FL (US)

(73) Assignee: Robert K. Hughes, Jr., Fort Myers, FL (US)

( * ) Notice: Subject to any disclaimer, the term of this patent is extended or adjusted under 35 U.S.C. 154(b) by 0 days.

(21) Appl. No.: 13/737,749

(22) Filed: Jan. 9, 2013

(65) Prior Publication Data

US 2013/0174776 A1 Jul. 11, 2013

Related U.S. Application Data

(60) Provisional application No. 61/584,552, filed on Jan. 9, 2012.

(51) Int. Cl.
*E01F 9/00* (2006.01)

(52) U.S. Cl.
USPC ..... 404/9

(58) Field of Classification Search
USPC ..... 404/9, 10, 12–15; 116/63 R, 63 T
See application file for complete search history.

(56) References Cited

U.S. PATENT DOCUMENTS 4,522,530 A * 6/1985 Arthur ..... 404/10
5,323,583 A * 6/1994 Venegas, Jr. ..... 52/309.4
5,354,143 A * 10/1994 Lindner ..... 404/9
6,059,488 A * 5/2000 Green ..... 404/12
6,851,888 B2 * 2/2005 Snagel et al. ..... 404/13
7,901,156 B2 * 3/2011 McCue et al. ..... 404/9
2009/0279951 A1 * 11/2009 Wheeler, Jr. ..... 404/10
2010/0164034 A1 * 7/2010 Park ..... 257/432
2010/0172693 A1 * 7/2010 Heald ..... 404/12
2010/0189497 A1 * 7/2010 Hughes, Sr. ..... 404/12
2010/0254761 A1 * 10/2010 Wheeler, Jr. ..... 404/10
2011/0182662 A1 * 7/2011 Audet ..... 404/12
2011/0182663 A1 * 7/2011 Harward et al. ..... 404/12

* cited by examiner

*Primary Examiner* — Raymond W Addie
(74) *Attorney, Agent, or Firm* — Bracewell & Giuliani LLP

(57) ABSTRACT

Embodiments of the invention are directed to a traffic control marker having a mesh base and an improved inner core. In accordance with various embodiments, there is provided a traffic control assembly, which includes a base selectively mountable adjacent a roadway, the base comprising a plurality of through holes, and a flexible tubular member connected to the base. The traffic control assembly further includes a flange selectively mountable below the base. The flange includes a plurality of through holes spaced around a portion of the circumference of the flange. Further, the traffic control assembly includes an adhesive material applied to an underside of the base and the flange to secure the traffic control assembly to the roadway. The adhesive material fills the plurality of through holes in the base and in the flange, when the traffic control assembly is mounted to the roadway. Various embodiments also provide for a flexible support arranged inside of the flexible tubular member and configured to increase the resiliency of the flexible tubular member to an impact by a moving vehicle.

19 Claims, 5 Drawing Sheets

FIG. 4
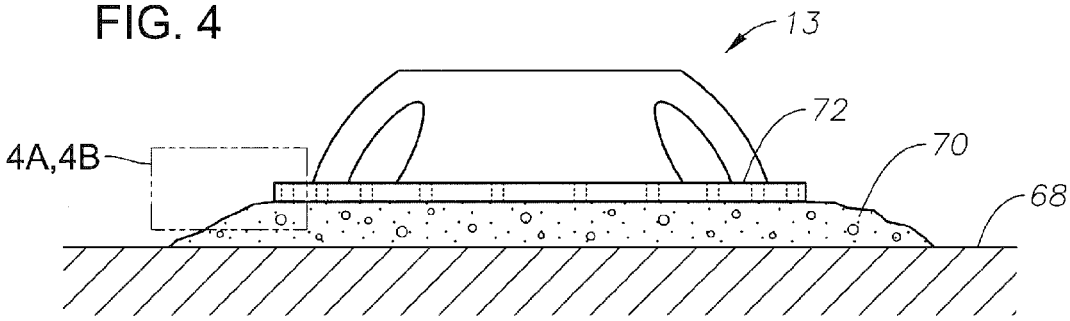
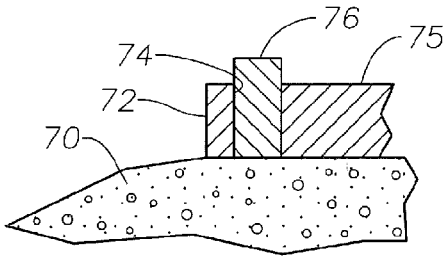
FIG. 4A
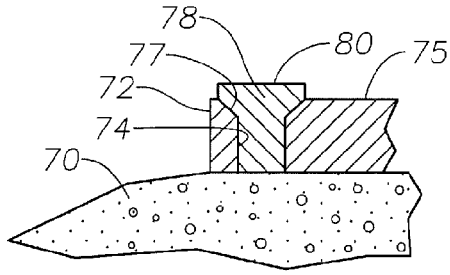
FIG. 4B
FIG. 5
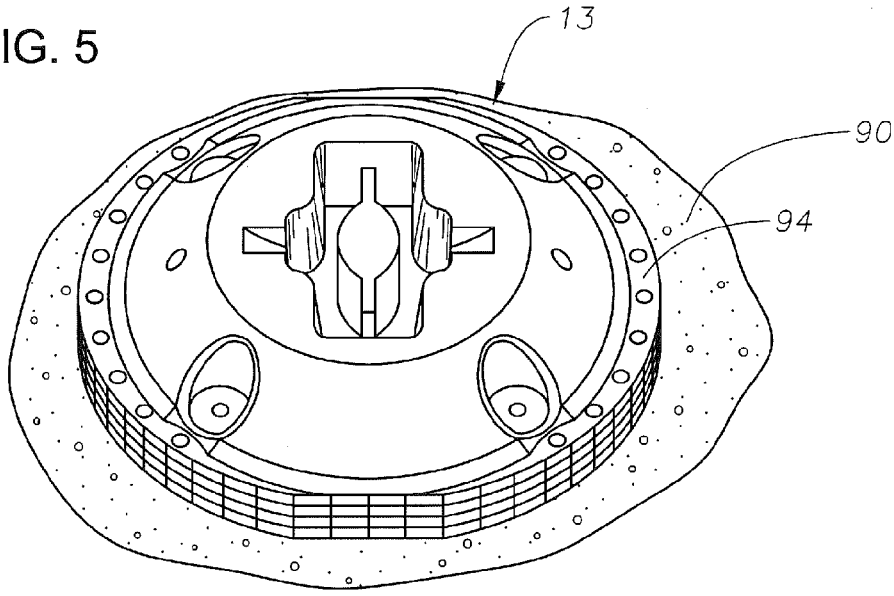

TRAFFIC CONTROL MARKER WITH MESH BASE

RELATED APPLICATION

This application is related to, and claims priority to, U.S. Provisional Patent Application Ser. No. 61/584,552, filed on Jan. 9, 2012, the disclosure of which is incorporated by reference in its entirety.

BACKGROUND

1. Field of the Invention

Embodiments of the invention generally relate to a traffic control device or marker (hereinafter collectively referred to as a "traffic control marker"). More particularly, various embodiments of the invention are directed to a traffic control marker having a mesh base and an improved inner core.

2. Description of the Related Art

Traffic control markers used on roadways or other marking areas are frequently struck by moving vehicles. These traffic control markers typically have an outer or primary tube mounted to a base. Typically, the traffic control marker includes a reflective sheeting partially or completely surrounding the primary tube to warn or guide an operator of the moving vehicle, for example, at night or through a construction zone. Examples of commonly used traffic control markers include traffic cones and barrels, as non-limiting examples.

Another type of traffic control marker is a flexible delineator highway marker. The highway marker typically includes a flexible insert positioned in a primary tube of the highway marker to provide it with a rebound effect. In particular, the insertion of the flexible insert into the primary tube of the highway marker allows the traffic control marker to return to a substantially upright position after being struck and deflected by a moving vehicle. In addition to other attachment methods, a conventional traffic control marker may be attached to the roadway using an epoxy or other adhesive.

A vehicular strike may overcome the seal created by the epoxy at the base of the traffic control marker, causing the traffic control marker to detach from the roadway at, or near, the base. Further, the primary tube, and thus the reflective sheet or indicia attached thereto, may detach from the traffic control marker upon impact by the moving vehicle. It can be costly and time consuming to repair or replace the damaged traffic control marker.

Thus, it would be desirable to provide a traffic control marker, or flexible highway marker, with an improved epoxy attachment mechanism capable of securing the primary tube to the base of the traffic control marker, thereby enhancing the structural integrity of the outer tube to prevent it from detaching from the traffic control marker on impact by a moving vehicle, improving the functioning life of the traffic control marker, and maintaining the performance of known types of flexible highway markers, when vehicles deflect them on the roadway or other marking area.

SUMMARY

Embodiments of the invention are directed to a traffic control marker having a mesh base and an improved inner core.

In accordance with an embodiment, there is provided a traffic control assembly, which includes a base selectively mountable adjacent a roadway, the base comprising a plurality of through holes, and a flexible tubular member connected to the base. The traffic control assembly further includes a flange selectively mountable below the base. The flange includes a plurality of through holes spaced around a portion of the circumference of the flange. Further, the traffic control assembly includes an adhesive material applied to an underside of the base and the flange to secure the traffic control assembly to the roadway. The adhesive material fills the plurality of through holes in the base and in the flange, when the traffic control assembly is mounted to the roadway.

In accordance with another embodiment, there is provided a traffic control assembly, which includes a base selectively mountable adjacent a roadway, a flexible tubular member connected to the base, and a flange selectively mountable below the base. The flange includes a mesh structure having a plurality of passages. The traffic control assembly further includes an adhesive material applied to an underside of the flange to secure the traffic control assembly to the roadway. When the traffic control assembly is mounted to the roadway, the adhesive material flows through the plurality of passages in the flange.

In accordance with another embodiment, there is provided a traffic control assembly, which includes a flexible support arranged inside of the flexible tubular member and configured to increase the resiliency of the flexible tubular member to an impact by a moving vehicle.

BRIEF DESCRIPTION OF DRAWINGS

So that the manner in which the features and advantages of the invention, as well as others which will become apparent, may be understood in more detail, a more particular description of the invention briefly summarized above may be had by reference to the embodiments thereof that are illustrated in the appended drawings, which form a part of this specification. It is to be noted, however, that the drawings illustrate only various embodiments of the invention and are therefore not to be considered limiting of the invention's scope as it may include other effective embodiments as well.

FIG. 4 is a side view of the base of the traffic control assembly, as shown in FIG. 3, in accordance with an embodiment of the invention.

FIGS. 4A and 4B are enlarged side views of the base of the traffic control assembly, as shown in FIG. 4, in accordance with embodiments of the invention.

FIG. 5 is another enlarged perspective view of the base of the traffic control assembly, as shown in FIGS. 1 and 2, in accordance with an embodiment of the invention.

DETAILED DESCRIPTION

Although the following detailed description contains many specific details for purposes of illustration, it is understood that one of ordinary skill in the relevant art will appreciate that many examples, variations, and alterations to the following details are within the scope and spirit of the invention. Accordingly, the exemplary embodiment of the invention described herein are set forth without any loss of generality, and without imposing limitations, relating to the claimed invention. Like numbers refer to like elements throughout.

Figure 1:
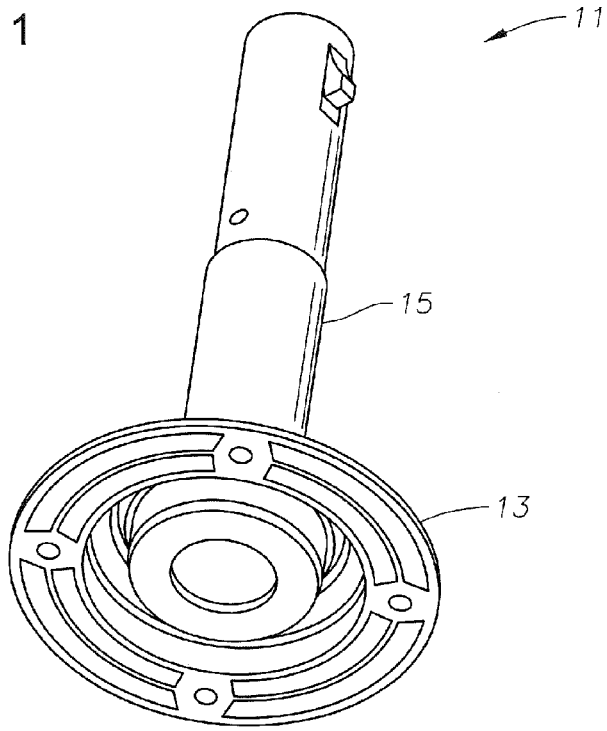
FIG. 1 is an isometric view of a lower portion of a traffic control assembly, in accordance with an embodiment of the invention.
Figure 3:
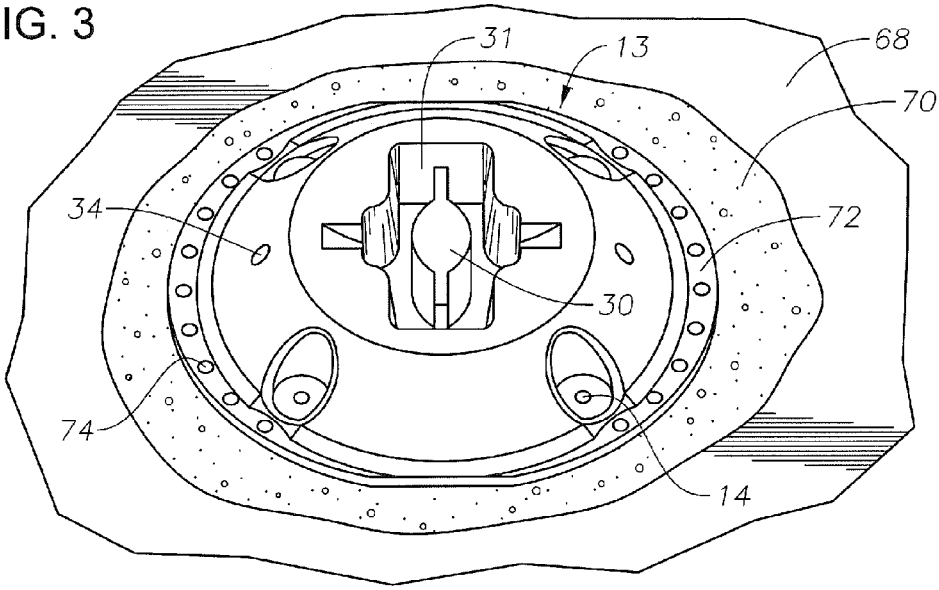
FIG. 3 is an enlarged perspective view of a base of the traffic control assembly, as shown in FIGS. 1 and 2, in accordance with an embodiment of the invention.
Figure 2:
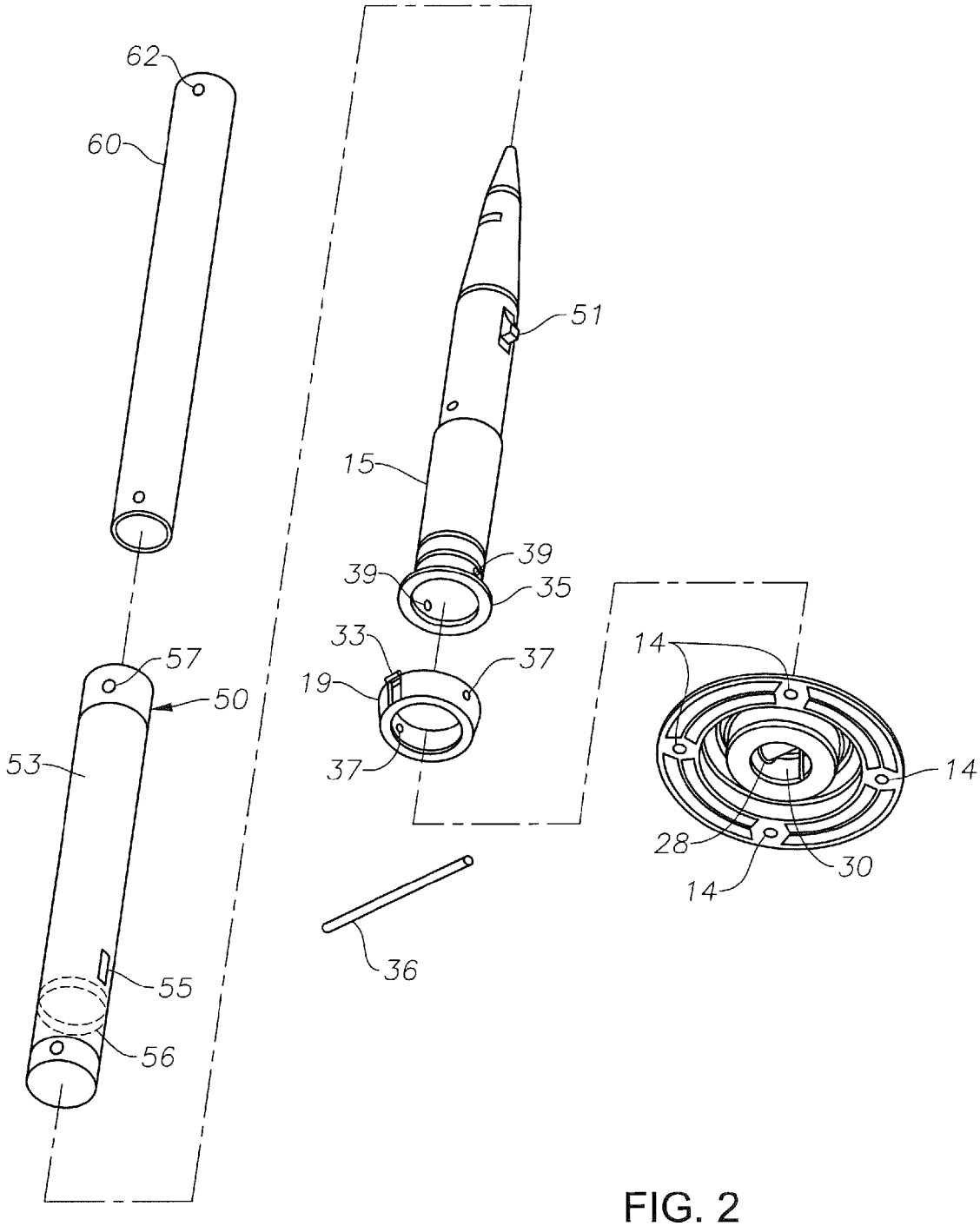
FIG. 2 is an exploded isometric view of a traffic control assembly, in accordance with an embodiment of the invention.

Referring to FIGS. 1-3, embodiments of a system, method and apparatus for a traffic control assembly are shown. A traffic control device, traffic control assembly, roadside marker, or flexible delineator 11 (hereinafter collectively referred to as "traffic control assembly 11") for marking roadways or other marking areas is shown. FIG. 1 is an isometric view of a lower portion of a traffic control assembly, in accordance with an embodiment of the invention. As shown in FIG. 1, the traffic control assembly 11, in accordance with at least one embodiment, includes a base 13 and a flexible marker or primary tube 15 that extends substantially vertically from the base 13, when the flexible marker or primary tube 15 is in a non-impacted and non-deformed state (i.e., not impacted or deformed by a moving vehicle).

In accordance with some embodiments, the base 13 includes a cylindrical and conical shape, while in other embodiments, the base 13 is configured in the shape of a square or rectangle, or alternatively any other suitable shape. These various shapes may be suitable for uneven terrain to better stabilize the traffic control assembly, when the surface of the supporting ground is not level. For example, on a roadway having a sloped shoulder, a base 13 with an elongated shape (e.g., oval with a size of, for example, 4 inches by 18 inches), with a long side of the base 13 being parallel to the roadway, may be used to better follow the contour of the shoulder in which the traffic control assembly is located. The base 13 is discussed in more detail below.

FIG. 2 is an exploded isometric view of a traffic control assembly, in accordance with an embodiment of the invention. FIG. 3 is an enlarged perspective view of a base of the traffic control assembly, as shown in FIGS. 1 and 2, in accordance with an embodiment of the invention. In accordance with at least one embodiment, the base 13 is designed to be secured to a roadway with an epoxy, or other attachment means, for example, an adhesive, a stake, or fasteners, as non-limiting examples. In accordance with various embodiments, the base 13 includes a plurality of axially extending holes 14, as shown in FIGS. 2 and 3, that are spaced apart about an outer circumference of the base 13. In accordance with at least one embodiment, the base 13 includes four axially extending holes 14. The holes 14 provide an alternate or additional mounting option for the base 13 to a roadway or other marking area with fasteners. The holes 14 receive fasteners, for example, screws, for mounting the base 13 to the roadway.

In accordance with some embodiments, an optional collar 19, as shown in FIG. 2, is included in the traffic control assembly. The optional collar 19 has a donut-shaped configuration that seats within a recess 31 formed in the base 13, as shown in FIG. 3, to circumscribe a hub 30 on the base 13. In accordance with an embodiment, the hub 30 and the recess 31 each have various cross-sectional shapes. In accordance with at least one embodiment, the hub 30 has a generally oval shape with extending surfaces on two ends. In accordance with at least one embodiment, a cross-shaped recess 31 is formed on an upper portion or face of the base 13. The cross-shaped recess 31 receives the corresponding lower portion of the flexible marker or primary tube 15, as shown in FIG. 2.

As further shown in FIG. 2, the optional collar 19 may be provided with an alignment feature 33, for example, a slot or tab, that is complementary to a feature on base 13 to orient the optional collar 19 relative to the base 13. An upper end of the optional collar 19 is open for receiving and seating a small, circumferential flange 35 located at the bottom of the flexible marker or primary tube 15. In accordance with various embodiments, both the optional collar 19 and the flexible marker or primary tube marker 15 are provided with through holes 37, 39, respectively in their side walls. Further, the base 13 also includes passage holes 34, as shown in FIG. 3. A pin 36 is extended laterally through the through holes 37, 39 in the optional collar 19 and the flexible marker or primary tube marker 15, respectively, to secure the components of the traffic control to one other.

In accordance with various embodiments, an upper portion of the flexible marker or primary tube 15, as shown in FIG. 2, includes a pair of ears or fingers 51 that are locking retention features for retaining a flexible outer tube or reflective component 50. The ears or fingers 51 are resilient members that slip through an outer tube 50 and lock into holes 55 formed in the sides of the outer tube 50. In an alternative embodiment, the ears or fingers 51 are formed on a flexible inner core, as will be discussed in more detail below.

In accordance with at least one embodiment, the flexible outer tube or reflective component 50 includes a plastic tubular member, as shown in FIG. 2, with an indicia or reflective sheeting 53 for greater visibility to, for example, an operator of a moving vehicle or a pedestrian. In an accordance with an alternative embodiment, the flexible outer tube or reflective component 50 is painted with reflective or fluorescent paint, or reflective or fluorescent beads can be attached to the flexible outer tube or reflective component 50. A metallic reinforcing ring 56 is embedded within the flexible outer tube or reflective component 50 at a point, for example, slightly below the holes 55. The reinforcing ring 56 makes the flexible outer tube or reflective component 50 more resistant to tearing, ripping, or breaking. The location of the reinforcing ring 56 within the flexible outer tube or reflective component 50 can vary depending on where stress dispersion is required, for example, at the base of the flexible outer tube or reflective component 50, if it is directly mounted to the base 13. After the flexible outer tube or reflective component 50 is installed on the flexible outer tube or reflective component 50, it may be removed by pressing the ears or fingers 51 inward and out of the holes 55, allowing it to be replaced or repaired, when necessary. In accordance with another embodiment, the flexible outer tube or reflective component 50 is removed by cutting or deforming the flexible outer tube or reflective component 50. Additional key features of the ears or fingers 51 will be discussed in more detail below.

In accordance with at least one embodiment, as further shown in FIG. 2, the traffic control assembly 11 includes a protective, cylindrical sleeve or cover 60 that is slid over the flexible outer tube or reflective component 50. The protective sleeve 60 is fastened to the flexible outer tube or reflective component 50 by securing means, for example, bolts that extend through holes 62 on the protective sleeve 60 aligned with holes 57 on the flexible outer tube or reflective component 50. In accordance with at least one embodiment, the protective sleeve 60 is glued to the flexible outer tube or reflective component 50. The protective sleeve 60 is made, for example, of a clear, high-impact strength, polycarbonate material that can protect the reflective sheeting 53 from the impact of a moving vehicle without compromising its reflective function.

In accordance with various embodiments, as shown in FIG. 3, the base 13 has a generally conical shape and is mounted to a surface 68, for example, of a roadway, with an epoxy 70 or other type of adhesive applied to the underside of the base 13 of the traffic control assembly 11 or to the surface 68, whereby the epoxy 70 fills the holes 14 of the base 13, when an underside of the base 13 is pressed against the surface 68. In accordance with at least one embodiment, epoxy 70 is also placed around upper and side surfaces of the base 13. Further, a flange 72 located below the base 13 includes a plurality of holes 74 spaced around a portion of the circumference of the flange 72 that are also filled with the epoxy 70, when the base 13 is pressed against the surface 68. The flange 72, in accordance with various embodiments, is made of a metallic or a non-metallic material and has a thickness ranging from about ⅛" to about ½". The holes 74 have a diameter ranging from about ⅛ " to about ½".

FIG. 4 is a side view of the base of the traffic control assembly, as shown in FIG. 3, in accordance with an embodiment of the invention. FIGS. 4A and 4B are enlarged side views of the base of the traffic control assembly, as shown in FIG. 4, in accordance with embodiments of the invention. In accordance with at least one embodiment, as shown in FIGS. 4 and 4A, a rivet 76 is formed by the epoxy 70 that cures after the epoxy 70 fills the holes 74 and flows through and past an upper surface 75 of the flange 72. The rivets 76 formed from the epoxy 70 provide an additional anchoring force to that provided by the epoxy 70 alone. In accordance with least one other embodiment, as shown in FIG. 4B, the holes 74 have an upper diameter 77 that is larger at the surface 75 of the flange 72 than at other points through the flange 72. In such an embodiment, a rivet 78 is formed by the epoxy 70 that cures after the epoxy 70 fills the holes 74 and flows through and past the upper surface 75 of the flange 72. Due to the increase in size at the upper diameter 77 of the hole 74, the rivet 78 has a head 80 with a larger diameter than the rivet 76 formed from the epoxy 70, as described above, thereby enhancing the effectiveness of the rivets 78 in providing an additional anchoring force.

Figure 6:
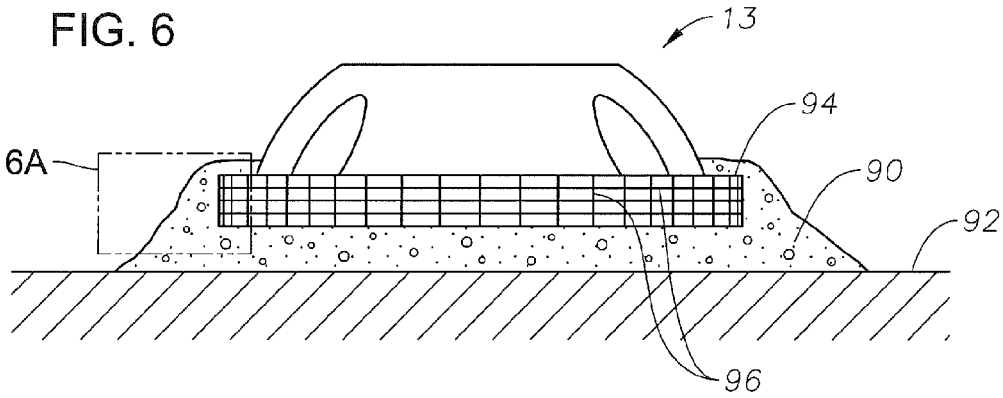
FIG. 6 is another side view of the base of the traffic control assembly, as shown in FIG. 5, in accordance with an embodiment of the invention.
Figure 6A:
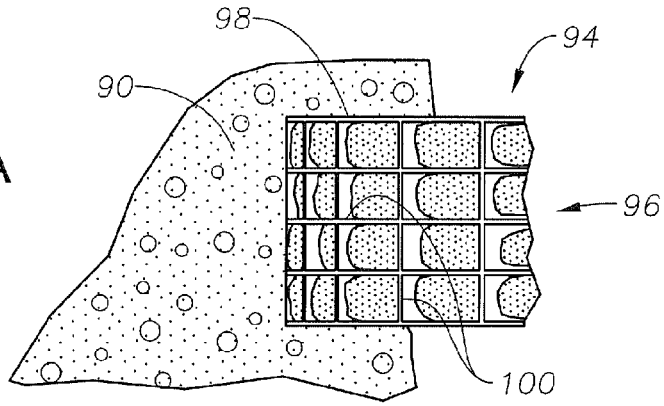
FIG. 6A is an enlarged side view of the base of the traffic control assembly, as shown in FIG. 6, in accordance with an embodiment of the invention.

FIG. 5 is another enlarged perspective view of the base of the traffic control assembly, as shown in FIGS. 1 and 2, in accordance with an embodiment of the invention. FIG. 6 is another side view of the base of the traffic control assembly, as shown in FIG. 5, in accordance with an embodiment of the invention. FIG. 6A is an enlarged side view of the base of the traffic control assembly, as shown in FIG. 6, in accordance with an embodiment of the invention.

In accordance with various embodiments, as shown in FIG. 5, the base 13 is mounted to a surface 92, as shown in FIG. 6A, for example, a roadway, with an epoxy 90 or other type of adhesive applied to an underside of the base 13 or to the surface 92. As shown in FIGS. 6 and 6A, a flange 94 located below the base 13 has a mesh structure 96 that extends downward from an upper surface 98 of the flange 94. In accordance with at least one embodiment, the mesh structure 96 circumscribes a lower portion of the base 13 and includes a plurality of passages 100 that are filled with the epoxy 90, when the base 13 is pressed against the surface 92. In this embodiment, the passages 100 of the mesh structure 96 are square-shaped, but can have other shapes as well. Further, the passages 100, in this embodiment, allow the epoxy 90 to flow in and through both sides of the mesh structure 96. Once cured, the epoxy 90 caught in the mesh structure 96 provides an additional anchoring force to that provided by the epoxy 90 alone. This embodiment may also be combined with the embodiments shown in FIGS. 3-4B.

Figure 7:
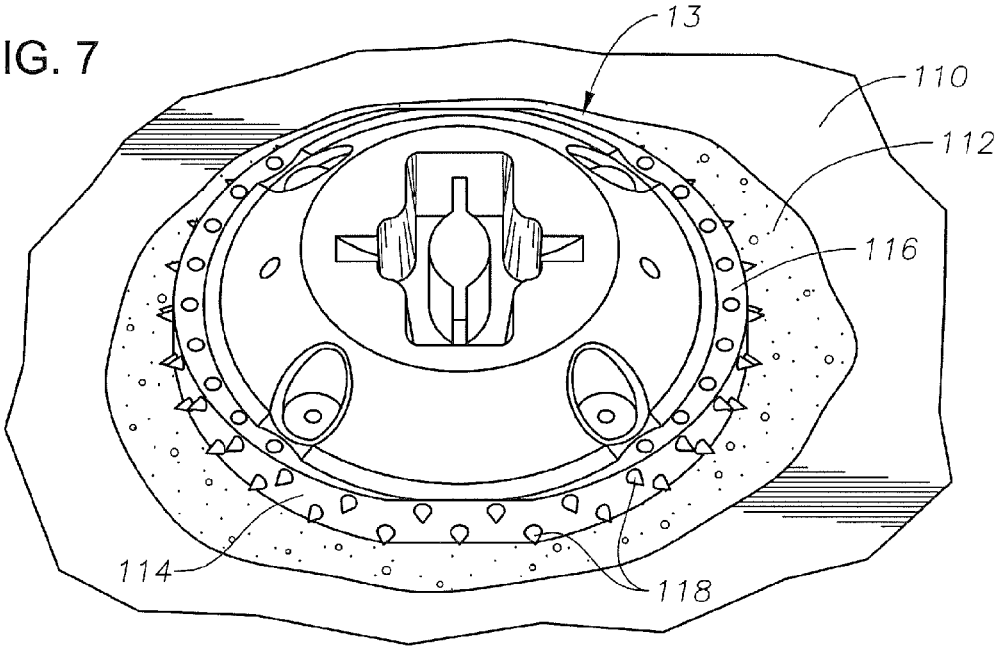
FIG. 7 is an enlarged perspective view of the base of the traffic control assembly, as shown in FIGS. 1 and 2, in accordance with an embodiment of the invention.

In accordance with another embodiment, as shown in FIG. 7, the base 13 has a conical shape similar to that shown in FIG. 3 and is mounted to a surface 110, for example, a roadway, with an epoxy 112 or other type of adhesive applied to an underside of the base 13 or to the surface 110. A flange 114 located below the base 13 extends downward from an upper surface 116 of the flange 114. In accordance with an embodiment, the flange 114 has a thickness ranging from about ⅛" to about ½". In this embodiment, the flange 114 includes a plurality of radial projections or spikes 118 that project radially outward from the flange 114. Although shown disposed along a circumferential line, the radial projections 118 may be disposed on the flange 114 in an irregular pattern. The radial projections 118 are formed out of metal or non-metal material. The radial projections 118 are surrounded by the epoxy 112, when the base 13 is pressed against the surface 110. The radial projections 118 are embedded within the epoxy 112, when the epoxy 112 cures and provides an additional anchoring force to that provided by the epoxy 112 alone. This embodiment may also be combined with the embodiments shown in FIGS. 3-6A.

In accordance with at least one embodiment, the flexible marker or primary tube 15 is sufficiently thick to resist casual bending or flexing along its length from forces, for example, a strong wind. As such, the flexible marker or primary tube 15 remains substantially vertically upright, when the flexible marker or primary tube 15 is in a non-impacted and non-deformed state (i.e., not impacted or deformed by a moving vehicle). The flexible marker or primary tube 15 is sufficiently flexible, so that it will elastically deform along its length, when a physical object forcibly applies a significant impact thereto, for example, by a moving vehicle or automobile.

In operation, when a moving vehicle (not shown) strikes the traffic control assembly 11, it is designed to allow the traffic control assembly 11 to elastically deform before returning to an upright position after impact. When a tire of the vehicle strikes the traffic control assembly 11, the tire rolls onto the conical portion of the base 13 before striking the flexible marker or primary tube 15. Upon impact from the tire, the flexible marker or primary tube 15 flexes or bends. The bottom portion of the flexible marker or primary tube 15 remains securely affixed to the base 13. After the vehicle and tire move past the traffic control assembly 11, the resilient elastic properties of the flexible marker or primary tube 15 allow it to return to an upright position. However, the repeated impact and vehicle weight can cause the bottom portion of the flexible marker or primary tube 15 to permanently bend or deform to the point that it does not return to an upright position.

Figure 8:
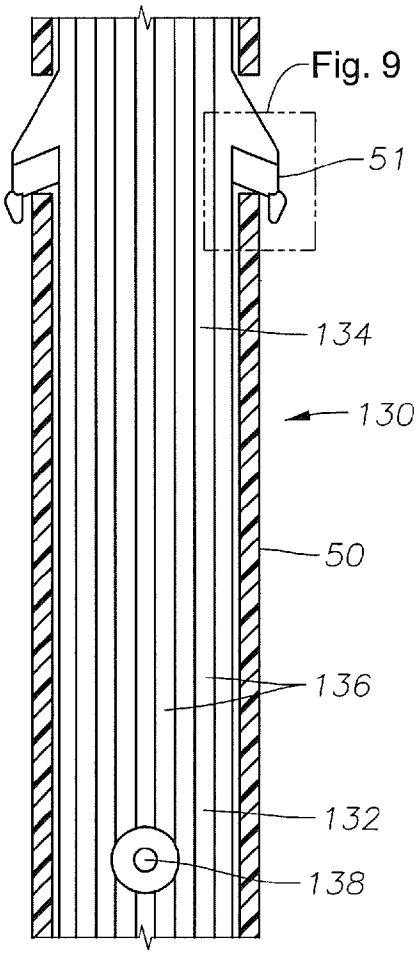
FIG. 8 is a partial sectional front view of a portion of a flexible core of the traffic control assembly, as shown in FIGS. 1 and 2, in accordance with an embodiment of the invention.
Figure 8A:
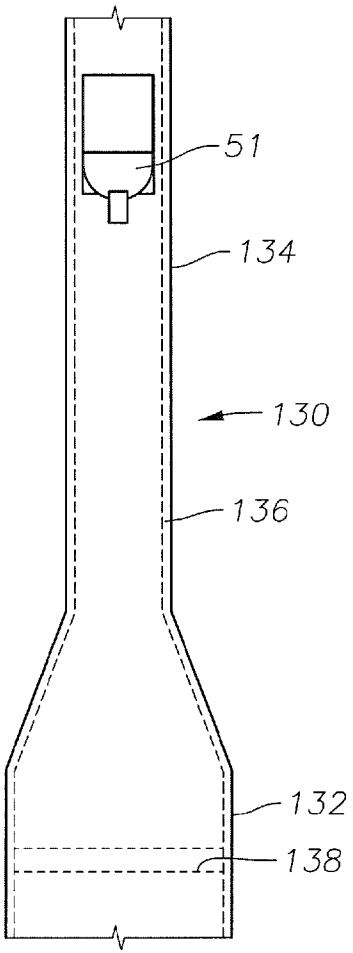
FIG. 8A is a side view of the portion of the flexible core for the traffic control assembly, as shown in FIG. 8 in accordance with an embodiment of the invention.

To improve the elastic properties of the flexible marker or primary tube 15, a flexible core 130 can be arranged inside the flexible marker or primary tube 15, as shown in FIGS. 8 and 8A. FIG. 8 is a partial sectional front view of a portion of a flexible core of the traffic control assembly, as shown in FIGS. 1 and 2, in accordance with an embodiment of the invention. FIG. 8A is a side view of the portion of the flexible core for the traffic control assembly, as shown in FIG. 8 in accordance with an embodiment of the invention.

In accordance with various embodiments, the flexible core 130 is formed from a resilient material, for example, rubber, as a non-limiting example. In accordance with at least one embodiment, the flexible core 130 replaces the flexible marker or primary tube 15. In such a case, the ears or fingers 51 are formed on the flexible core 130 in order to retain the flexible outer tube 50. As shown in FIG. 8, the flexible core 130 has a lower portion 132 that is thicker than an upper portion 134. The reduction in thickness from the lower portion 132 to the upper portion 134 is gradual to reduce the stress at the reduction. The lower portion 132 also has a generally cylindrical shape, but can have other shapes as well. The flexible core 130 is more flexible at the upper portion 134 than at the lower portion 132. The flexible core 130 further includes ridges 136 formed from an upper end to a lower end of the flexible core 130. The ridges 136 provide the core 130 with additional strength and increase the surface area through which an impact force is distributed. Further, the flexible core includes a hole 138 that traverses the lower portion 132 to allow the pin 36 to hold the flexible core 130 in place when assembled. The height of the flexible core 130 may vary relative to the height of the traffic control assembly 11. When the flexible marker or primary tube 15 with the flexible core 130, or the flexible core 130 by itself, is struck by a moving vehicle, the traffic control assembly 11 returns to a substantially upright (e.g., vertical) position.

Figure 9:
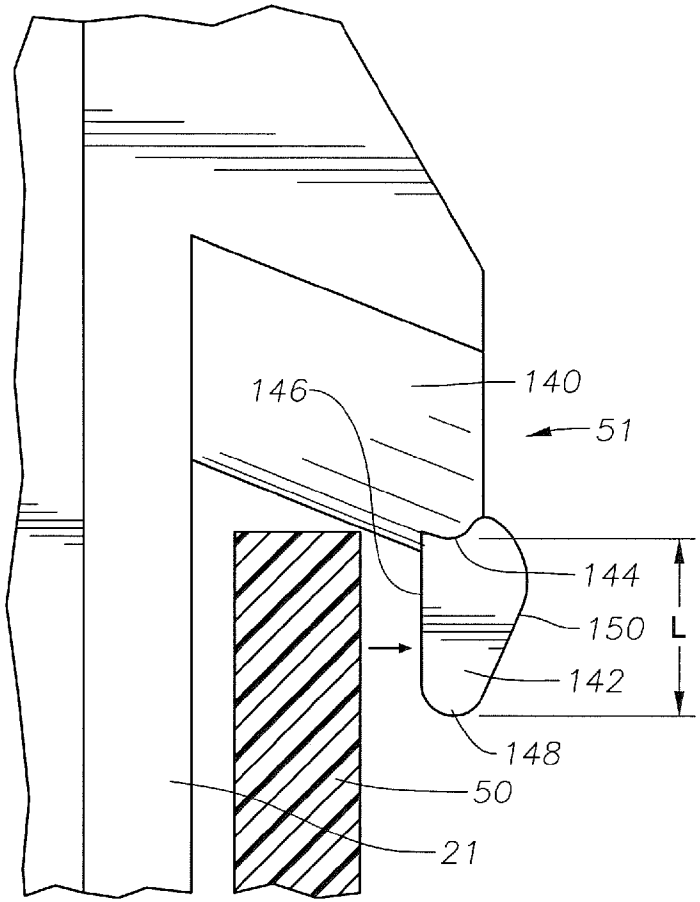
FIG. 9 is a partial sectional view of a retaining finger of an inner core of the traffic control assembly, as shown in FIG. 8, in accordance with an embodiment of the invention.

FIG. 9 is a partial sectional view of a retaining finger of an inner core of the traffic control assembly, as shown in FIG. 8, in accordance with an embodiment of the invention. As shown in FIGS. 8 and 9, the ears or fingers 51, which may be a pair of a plurality of ears, are formed on the upper portion 134 of the flexible core 130. In accordance with an embodiment, the ears or fingers 51 extend radially outward from the flexible core 130 and taper downward to aid in retaining the outer tube 50 on the flexible core 130. The ears or fingers 51 have a thicker portion 140 that provides rigidity to the ears or fingers 51. When the outer tube 50 is struck by a moving vehicle, the outer tube 50 moves in the direction shown by the arrow (i.e., in an outward direction). To prevent the outer tube 50 from detaching from the flexible core 130, an extension or finger 142 is formed at a nose end 144 of the thicker portion 140 of the ears or fingers 51. The extension or finger 142 extends downward from the ear or finger 51 to act as a stop to the outer tube 50 during impact to thereby maintain the position of the outer tube 50 with the flexible core 130. In accordance with at least one embodiment, the extension 142 has a generally straight inner surface 146, a curved lower end 148, and a tapered outer surface 150. The extension 142 has a length or height, L, ranging from about ¼" to about ½". The outer tube 50 preferably has a thickness of between about 0.05" to about 0.1".

Embodiments of the invention provide several important and non-obvious advantages over conventional traffic control markers. For example, various embodiments of the invention provide an improvement for the anchoring of the base of the traffic control assembly to a surface, for example, a roadway, via an epoxy, thereby increasing the life and improving the performance of the traffic control assembly. Embodiments of the invention also improve the elastic properties of the traffic control assembly through the use of a flexible core mounted to the base to thereby increase life and improve performance. At the same time, the retaining ears or ringers are improved to aid in preventing an outer tube of the traffic control assembly, and thus reflective indicia, from detaching from the traffic control assembly.

The present invention may suitably comprise, consist or consist essentially of the elements disclosed and may be practiced in the absence of an element not disclosed. For example, it can be recognized by those skilled in the art that certain structural elements can be combined into a single structural element.

Unless defined otherwise, all technical and scientific terms used have the same meaning as commonly understood by one of ordinary skill in the art to which this invention belongs.

The singular forms "a," "an," and "the" include plural referents, unless the context clearly dictates otherwise.

As used herein and in the appended claims, the words "comprise," "has," and "include" and all grammatical variations thereof are each intended to have an open, non-limiting meaning that does not exclude additional elements or steps.

As used herein, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that the mere use of the term "first" and "second" does not require that there be any "third" component, although that possibility is contemplated under the scope of the embodiments of the present invention.

Ranges may be expressed herein as from about one particular value, and/or to about another particular value. When such a range is expressed, it is to be understood that another embodiment is from the one particular value and/or to the other particular value, along with all combinations within said range.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

I claim:

1. A traffic control assembly, comprising:

a base selectively mountable adjacent a roadway, the base comprising a plurality of through holes;

a flexible tubular member connected to the base;

a flange selectively mountable below the base, the flange comprising a plurality of through holes spaced around a portion of the circumference of the flange; and an adhesive material applied to an underside of the base and the flange to secure the traffic control assembly to the roadway, wherein the adhesive material fills the plurality of through holes in the base and in the flange, when the traffic control assembly is mounted to the roadway.

2. A traffic control assembly of claim 1, wherein, when the traffic control assembly is mounted to the roadway, the adhesive material forms a rivet in each of the through holes in the base and in the flange, each rivet being configured to enhance the mounting of the traffic control assembly to the roadway.

3. A traffic control assembly of claim 1, wherein, wen the traffic control assembly is mounted to the roadway, an upper surface of the flange comprises the adhesive material.

4. A traffic control assembly of claim 1, wherein a top portion of each of the plurality of through holes in the flange comprises a larger diameter than a bottom portion of each of the plurality of through holes in the flange.

5. A traffic control assembly of claim 1, wherein the flange comprises a thickness of about ⅛" to about ½".

6. A traffic control assembly of claim 1, wherein each of the plurality of through holes in the flange comprises a diameter of about ⅛" to about ½".

7. A traffic control assembly of claim 1, further comprising:

a tubular reflective member coaxially mounted on the flexible tubular member.

8. A traffic control assembly of claim 1, further comprising:

a substantially transparent and annular protective sleeve circumscribing the tubular protective member.

9. A traffic control assembly of claim 1, wherein the base comprises a shape configured to stabilize the traffic control assembly on an uneven surface of the roadway.

10. A traffic control assembly of claim 1, further comprising:

a collar connected to a bottom portion of the flexible tubular member, the collar being configured to circumscribe a hub formed in the top surface of the base to connect the base and the flexible tubular member.

11. A traffic control assembly of claim 1, further comprising:

a flexible support arranged inside of the flexible tubular member and configured to increase the resiliency of the flexible tubular member to an impact by a moving vehicle.

12. A traffic control assembly of claim 11, wherein a lower portion of the flexible support is thicker than an upper portion of the flexible support.

13. A traffic control assembly of claim 11, wherein the flexible support comprises a plurality of ridges disposed circumferentially around the flexible support.

14. A traffic control assembly of claim 11, wherein the flexible support comprises a hole that traverses a lower portion of the flexible support to allow a pin to hold the flexible support in place in the flexible tubular member.

15. A traffic control assembly, comprising:

a base selectively mountable adjacent a roadway;

a flexible tubular member connected to the base;

a flange selectively mountable below the base, the flange comprising a mesh structure having a plurality of passages; and an adhesive material applied to an underside of the flange to secure the traffic control assembly to the roadway, wherein the adhesive material flows through the plurality of passages in the flange, when the traffic control assembly is mounted to the roadway, and wherein the plurality of passages through the mesh structure comprise a substantially horizontal orientation, such that the adhesive material flows through one side of the mesh structure to the other side of the mesh structure, when the traffic control assembly is mounted to the roadway.

16. A traffic control assembly of claim 15, wherein the flange comprises a thickness of about ⅛" to about ½".

17. A traffic control assembly of claim 15, wherein the flange further comprises a plurality of radial projections disposed along a circumferential edge of the flange.

18. A traffic control assembly of claim 17, wherein the plurality of radial projections are disposed along the circumferential edge of the flange in an irregular pattern.

19. A traffic control assembly of claim 17, wherein, when the traffic control assembly is mounted to the roadway, the plurality of radial projections are embedded within the adhesive material.

* * * * *